US005571460A

United States Patent [19]

Choi et al.

[11] Patent Number: 5,571,460

[45] Date of Patent: Nov. 5, 1996

[54] LIQUID COMPOSITION EMITTING FAR INFRARED RAYS AND METHOD FOR PREPARATION THEREOF

[75] Inventors: Su I. Choi, Seoul; Yong H. Kim, Kyungki-Do, both of Rep. of Korea

[73] Assignee: Korean Angora Co., Ltd., Kyungi-Do, Rep. of Korea

[21] Appl. No.: 369,514

[22] Filed: Jan. 6, 1995

[30] Foreign Application Priority Data

Jan. 6, 1994 [KR] Rep. of Korea ..... 94-160

[51] Int. Cl.[6] ..... F21V 9/04; C09K 11/08

[52] U.S. Cl. ..... 252/587; 252/301.4 R; 252/301.4 S; 252/700

[58] Field of Search ..... 252/587, 301.4 R, 252/301.4 S, 700

[56] References Cited

U.S. PATENT DOCUMENTS 3,857,054 12/1974 Lehmann et al. ..... 252/301.4 R 4,071,465 1/1978 Vodoklys ..... 252/301.4 R 4,965,434 10/1990 Nomura et al. ..... 252/587

*Primary Examiner*—Philip Tucker

*Attorney, Agent, or Firm*—Richard C. Litman

[57] ABSTRACT

A liquid (ionized) composition emitting far infrared rays and a method for preparation thereof which can be used for a variety of applications is disclosed. The composition is prepared according to a preparing method, comprising the steps of: dissolving sodium silicate, sodium aluminate, sodium oxide, sodium thiosulfate, germanium dioxide, and highly pure white sugar at a temperature of 20° to 40° C. and mixing the dissolved solutions to resultingly prepare a first solution; adding a second solution made by ionizing gold to chloroauric acid and a third solution made by ionizing silver nitrate to silver thiosulfate to the first solution; and maintaining the resultant mixture at ordinary temperature (15° to 25° C.) for 48 to 72 hours. The highly pure white sugar of the first solution in the composition may further comprise an aqueous potassium carbonate solution added therein.

13 Claims, 2 Drawing Sheets

LIQUID COMPOSITION EMITTING FAR INFRARED RAYS AND METHOD FOR PREPARATION THEREOF

BACKGROUND OF THE INVENTION

1. Field of the Invention

The present invention relates, in general, to a liquid (ionized) composition emitting far infrared rays and a method for preparation thereof and, more particularly, to a highly functional liquid (ionized) composition emitting far infrared rays, which radiates far infrared rays of high efficiency at ordinary temperature (15° to 25° C.) when it is coated or impregnated on articles such as fiber products, and a method for preparation of such liquid (ionized) composition to be used for a variety of applications.

2. Description of the Prior Art

In general, as demonstrated by Nuclear Magnetic Resonance (NMR), far infrared rays are electromagnetic waves between 4.0 and 1,000 microns, which activate water molecules so as to be easily absorbed into the living body and which are capable of smoothing various physiological functions of the living body. In addition, it has been found through various experiments that the energy of far infrared rays can be easily absorbed into the living body, and that the absorbed energy provides necessary energy for the activation of body fluids and for physiological functions of the living body, thereby vitalizing the physiological functions of the living body.

With respect to the human body, far infrared rays have the following functions:

(1) the far infrared rays absorbed into the skin tissue change to heat, thereby raising the temperature of the skin tissue and raising the body temperature at the hypodermic deep layer so that a warm sensation is felt;

(2) increasing the flow of blood at the skin by enlarging the capillary vessels so as to promote the circulation of blood;

(3) activating the metabolism;

(4) abating pain; and (5) enhancing the rebirth ability of tissues so as to enable humans to recover from fatigue, to promote health, to dissolve insomnia and stress, and to heal chronic diseases.

In addition, far infrared rays are effective in accelerating the growth of animals and plants, maintaining the freshness of food, aging food, promoting the taste of food, and cleaning room air.

Various products utilizing such properties of far infrared rays have been developed and sold in the market, such as fiber products, tableware, and health products. Home appliances utilizing far infrared rays have also been recently developed, such as refrigerators which utilize far infrared rays to maintain the freshness of food.

Particularly in Japan, by utilizing already developed bioceramic materials emitting far infrared rays and powder techniques, various products emitting far infrared rays have rapidly been developed and produced. The market scale of such products amounts to three trillion yen.

Products using conventional bioceramic materials emitting far infrared rays have been prepared by dispersing powder bioceramics, in which an abundance of emissive material such as alumina silica is contained in ammonia water or resin having cation radicals, and then by attaching the dispersion on the surface of various products through adhesives.

However, because such materials emitting far infrared rays in these products are presently in a solid state, the coating cannot be applied uniformly on the surfaces of various products, and therefore, products using the powder phase composition as described above cannot sufficiently emit the far infrared rays. Also, since the composition is effective in radiating far infrared rays only when a high temperature (e.g., 200° to 500° C.) is applied to the products, favorable effects cannot be expected at room or ordinary temperature.

Moreover, the products coated with the materials emitting far infrared rays produced by conventional methods have other inefficiencies: the products have rough surfaces; dusts are produced, particularly when the composition is applied on fiber; and the composition cannot be applied on various products because it is produced by dot or spray techniques so that the dyeing ability of the fiber products is restricted.

SUMMARY OF THE INVENTION

The present invention has been made in view of the above-mentioned problems encountered in the prior art. Accordingly, an object of the present invention is to provide a liquid (ionized) composition emitting far infrared rays which emits far infrared rays with improved efficiency.

In other words, an object of the present invention is to provide a liquid (ionized) composition emitting far infrared rays and a method for preparing such liquid (ionized) composition emitting far infrared rays, which emits the far infrared rays more effectively when applied on various products, which has a more superior coating ability than conventional bioceramics so that it can be applied on various products, and which can be used to manufacture various fiber products with enhanced flexibility and dyeing ability.

In accordance with the present invention, the above object can be accomplished by providing a method for preparing a liquid (ionized) composition emitting far infrared rays, comprising the steps of:

dissolving sodium silicate, sodium aluminate ($AlNaO_2$), sodium oxide ($Na_2O$), sodium thiosulfate ($Na_2S_2O_3$), germanium dioxide ($GeO_2$), and highly pure white sugar in water at a temperature of 20° to 40° C., and mixing the dissolved solution to resultingly prepare a first solution;

adding a second solution made by ionizing gold to chloroauric acid ($HAuCl_4.H_2O$) and a third solution made by ionizing silver nitrate to silver thiosulfate ($Ag_2S_2O_3$) to the first solution; and maintaining the resultant mixture at ordinary temperature for about 48 to 72 hours.

Preferably, the highly pure white sugar of the first solution will further include purified glucose mixed therein.

Preferably, the first solution will further include an aqueous potassium carbonate solution added therein.

Moreover, the above object can also be accomplished by providing a liquid composition emitting far infrared rays produced in accordance with the above preparing method.

DETAILED DESCRIPTION OF THE PREFERRED EMBODIMENTS

Figure 1:
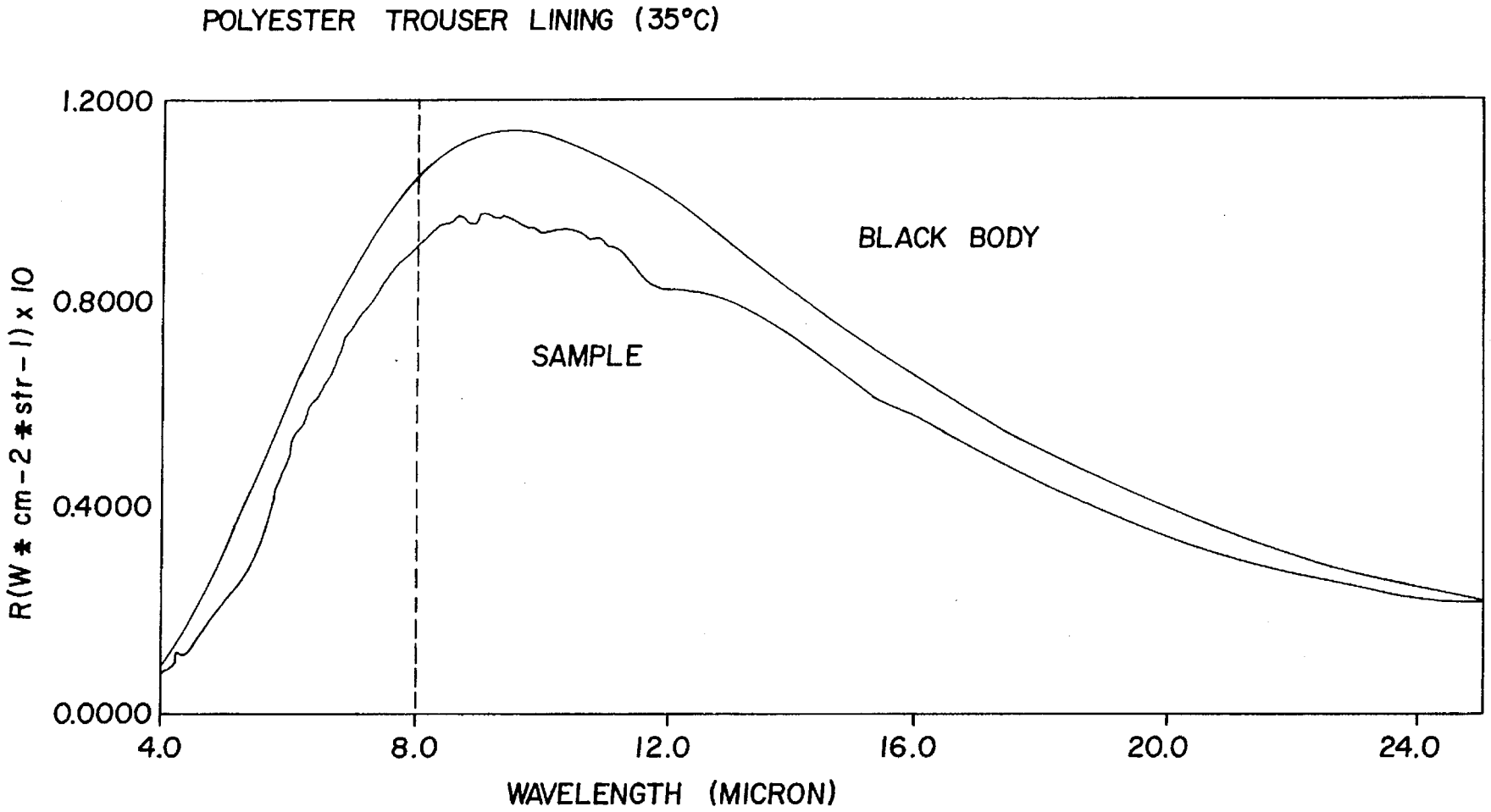
FIG. 1 is a graph showing the measured values of emissivities of far infrared rays emitted from synthetic fiber impregnated with the liquid composition emitting far infrared rays in accordance with the present invention.

As used in this description, "highly pure white sugar" means white sugar having a purity higher than 99%.

In the present invention, the thiosulfate solution and highly pure white sugar are added to accelerate liquefaction and to vatalize the ionic bond of metal atoms. They also absorb much of the oxygen from the air to accelerate the activation of water, thereby accelerating the solution of the constituents of the liquid composition emitting far infrared rays in accordance with the present invention.

Gold ion is generally used to cure cancerous peritonitis, cancerous pleurisy, and cancer of the genitals. It is known that these functions of gold ion result because the gold ion binds with organisms in the living body so that far infrared rays such as sun energy can reach the hypodermic deep layer and also be radiated effectively even at a low temperature, thereby raising the temperature of the hypodermic deep layer.

Accordingly, these properties of gold ion are utilized in the present invention.

Silver is known to be the highest among metals in terms of reflective power for infrared and visible rays and in terms of electric and the thermal conductivities, although its reflective power of ultraviolet rays is poor when compared to other metals.

Silver also has a tendency to absorb much oxygen when melted and to release oxygen when cooled.

Accordingly, after fiber is first dipped in the liquid composition emitting far infrared rays containing ionized silver thiosulfate, the dipped fiber is first dried at a temperature of 70° to 80° C., and then heated at a temperature of 100° to 120° C. to absorb oxygen, and finally, is cooled to release oxygen. Thus, the present invention utilizes the above-mentioned characteristics of silver.

The amounts of gold ion and silver ion used in the present invention vary depending on the purpose of such products.

Silicon is the most efficient semiconductor material and is known as a highly functional raw material which emits many far infrared rays of shortwave length.

Thus, in the present invention, the liquid composition emitting far infrared rays is prepared by liquefying these noble metals and semiconductor material.

The method for preparing the liquid composition emitting far infrared rays in accordance with the present invention will be more concretely described hereinafter.

First, sodium silicate, sodium aluminate, sodium oxide, sodium thiosulfate, germanium dioxide and highly pure white sugar are respectively dissolved in purified water at a temperature of 20° to 40° C., and then mixed to prepare the first solution. At this time, it is also possible to use highly pure white sugar with purified glucose mixed therein.

In the present invention, for preparing the first solution, it is preferred that the weight ratio of sodium thiosulfate to sodium silicate ranges 1:5–20 and the weight ratio of sodium thiosulfate to sodium aluminate ranges 1:2–8. And, the weight ratio of sodium thiosulfate to sodium oxide preferably ranges 1:2–5 and the weight ratio of sodium thiosulfate to highly pure white sugar preferably ranges 1:5–12.

Furthermore, when the aqueous potassium carbonate solution is added, the weight ratio of sodium thiosulfate to calcium carbonate preferably ranges 1:5–10.

However, germanium dioxide is dissolved in water having the same volume as that of water used to dissolve each of the other components of the first solution, and then its supernatant is used in the preparation of the first solution.

Gold is ionized to chloroauric acid to prepare the second solution.

The chloroauric acid solution ($HAuCl_4.H_2O$) used as gold ion in the present invention can be prepared by using the known processes for preparing chloroauric acid. It is preferable to use a process wherein gold is dissolved in nitrohydrochloric acid which is a mixed solution of concentrated hydrochloric acid and concentrated nitric acid.

That is, a proper amount of gold is introduced into a crucible, melted at a temperature of about 1100° C., and then added to purified water while stirring so that the gold is split finely. Next, nitrohydrochloric acid ($HCl:HNO_3=3:1$) is added thereto, and then dissolved completely at a temperature of 40° to 50° C. to be ionized. Thus, the chloroauric acid solution is prepared.

Meanwhile, silver nitrate is ionized to silver thiosulfate so that the third solution is prepared.

Silver thiosulfate, which serves as a silver ion in the liquid composition in the present invention, can be prepared in accordance with prior art methods. Among the known methods for preparing silver thiosulfate, in the preferred method an aqueous silver nitrate solution is mixed with an aqueous sodium chloride solution to cause the precipitation of silver chloride. Sodium thiosulfate is then added to the precipitate (silver chloride), and the resultant mixture is heated while stirring at a temperature of 30° to 40° C., whereby a transparent aqueous thiosulfate solution is prepared.

Although silver oxide or silver nitrate can be used, they are unpreferred because they tend to change to black when exposed to sunshine or heat, so that a product using them is discolored after it is processed. Silver nitrate is particularly unsuitable because it changes to brown when contacting with organisms.

Therefore, silver thiosulfate is used as the silver ion in the present invention because it does not injure a product even when the product is coated or impregnated with it.

In preparing the second solution according to the present invention, it is preferred that the weight of the amount of gold used is the same as or ten times that of the weight of the amount of sodium thiosulfate. And, in preparing the third solution, it is preferred that the weight of the amount of silver nitrate used is in the range of 0.5 times to twice that of the weight of the amount of sodium thiosulfate.

The first solution, the second solution and the third solution prepared as described above are mixed and then maintained at ordinary temperature (15° to 25° C.) for 48 to 72 hours.

In this procedure, substitution reaction of metal atoms with organic compounds occurs, so that the liquid (ionized) composition emitting far infrared rays is a solution in which the ion equilibrium and the mixed equilibrium of metals is prepared.

At this time, the mixture must be maintained between 48 and 72 hours, because the ionization to decrease the emitting efficiency of the composition does not completely take place when the maintenance time is less than 48 hours, and the ionization does not proceed when the maintenance time is more than 72 hours.

The liquid (ionized) composition emitting far infrared rays according to the present invention can be used in coating or impregnating various products, such as fibers, home appliances, bedding, tableware, various plastic products, and the like.

The liquid (ionized) composition emitting far infrared rays according to the present invention can be used properly diluted or as an undiluted solution.

The liquid (ionized) composition emitting far infrared rays according to the present invention can secure a superior emitting efficiency of far infrared rays than the conventional powder phase bioceramics, because the atoms emitting the far infrared rays, i.e., gold, silver, and silicon, are present in active ionic states which can more effectively radiate the far infrared rays.

Furthermore, because the composition emitting far infrared rays according to the present invention can be impregnated or coated on various products in a liquid state, the liquid composition can be uniformly absorbed into or coated on the products, thereby preparing the products so that they more effectively emit the far infrared rays.

Moreover, since a silver ion emits oxygen slowly, this ion in particular improves the heat insulating property, the flexibility, and the wearability of fiber products.

Also, the liquid (ionized) composition emitting far infrared rays according to the present invention does not freeze even at a temperature of −15° C., is free of colors and odors, and retains emitting efficiency without causing decomposition or degeneration.

The emissivity of the far infrared rays of fiber products prepared using the liquid composition emitting far infrared rays according to the present invention was confirmed in the following manner. First, a fiber product was impregnated with the liquid composition and dried. Thereafter, the dipped and dried sample was sent to the Far Infrared Rays Application Institute in Osaka, Japan so that the emissivity and emitting intensity of the far infrared rays could be measured. The results of the measurement confirmed that the emissivity of the far infrared rays of the liquid composition according to the present invention was more than 80% at a temperature of 35° C. (See FIG. 1), and that the emitting intensity was similar to that of a black body having the highest emissivity of far infrared rays (See FIG. 2). In short, the liquid composition was excellent in emitting far infrared rays.

The present invention is further described with reference to, but not limited by, the following examples.

EXAMPLE 1

A first solution is prepared with the following composition:

| | |
|---|---|
| sodium silicate | 12.0 g |
| sodium aluminate | 4.0 g |
| sodium oxide | 3.0 g |
| sodium thiosulfate | 1.0 g |
| germanium dioxide | 3.0 g |
| highly pure white sugar | 10.0 g |

The above-listed components are respectively dissolved in 170 ml of purified water at a temperature of 20° to 40° C. and then mixed. The germanium dioxide, however, is dissolved in 170 ml of purified water but its supernatant only is used in the mixing.

4 g of gold having a purity of 99.9% are introduced into a crucible and melted at a temperature of about 1100° C. using a petroleum lamp. The melted gold is added to 1000 ml of purified water and stirred to split the gold finely. The split gold is introduced into a beaker and 10 ml of nitrohydrochloric acid are added thereto. Then, the resultant mixture is completely dissolved at a temperature of 40° to 50° C. to be ionized.

After the above step is completed, a yellow chloroauric acid solution (a second solution) is prepared.

1 g of silver nitrate is dissolved in 10 ml of purified water at ordinary temperature, while 3 g of sodium chloride are dissolved in 50 ml of purified water at ordinary temperature. The above two solutions are mixed so that the precipitation of white silver chloride occurs. The resultant precipitate is separated and then washed with purified water three times. Next, an amount of water equal to twice the amount of the precipitate and 3 g of sodium thiosulfate are added to the separated silver chloride. The resultant mixture is heated at a temperature of about 30° to 40° C. for 20 to 30 minutes while stirring to dissolve the silver chloride, by which an odorless and colorless silver thiosulfate solution (a third solution) is prepared.

The first solution, the second solution, and the third solution prepared as described above are mixed and then maintained at ordinary temperature for more than 48 hours.

The liquid composition emitting far infrared rays prepared in this example is a transparent colorless liquid.

EXAMPLE 2

A first solution is prepared with the following composition:

| | |
|---|---|
| sodium silicate | 15.0 g |
| sodium aluminate | 5.0 g |
| sodium oxide | 3.0 g |
| sodium thiosulfate | 1.0 g |
| germanium dioxide | 3.0 g |
| potassium carbonate | 8.0 g |
| purified glucose | 3.0 g |
| highly pure white sugar | 7.0 g |

The above-listed components are respectively dissolved in 170 ml of purified water at 25° C. and the resultant solutions are mixed. The germanium dioxide, however, is dissolved in 170 ml of purified water but its supernatant only is used in the mixing.

3 g of gold having a purity of 99.9% are introduced into a crucible and melted at a temperature of about 1100° C. using a petroleum lamp. The melted gold is added to 1000 ml of purified water while stirring to split the gold finely. The split gold is introduced into a beaker, and 10 ml of nitrohydrochloric acid are added thereto. The resultant mixture is completely dissolved at a temperature of 40° to 50° C. to be ionized.

After this step is completed, a yellow chloroauric acid solution (a second solution) is prepared.

1 g of silver nitrate is dissolved in 10 ml of purified water at ordinary temperature. 3 g of sodium chloride are dissolved in 50 ml of purified water at ordinary temperature. The above two solutions are then mixed to effect the precipitation of silver chloride. The resultant precipitate is separated, and then washed with purified water three times. Next, an amount of water equal to twice the amount of the precipitate is added to the separated silver chloride, 3 g of sodium thiosulfate are added thereto, and the resultant mixture is heated at a temperature of about 30° to 40° C. for 20 to 30 minutes while stirring to dissolve the silver chloride. Thereby, a colorless and odorless silver thiosulfate solution (a third solution) is prepared.

The first solution, the second solution and the third solution prepared as described above are mixed and then maintained at ordinary temperature for more than 48 hours.

The liquid composition emitting far infrared rays prepared in this example is a colorless transparent liquid.

EXAMPLE 3

Measurements of the Emissivity and Emitting Intensity of Far Infrared Rays

Polyester synthetic fiber lining material for trousers was impregnated for 30 seconds with the liquid composition emitting far infrared rays prepared in Example 2 above, and then dried to provide a test sample.

The test sample was sent to the Far Infrared Rays Application Institute in Osaka, Japan so that the emissivity and the emitting intensity of the far infrared rays could be measured. The device used for the measurements was JIR-E500, and the measurements were carried out under the following conditions: a resolution of 1/16 cm; an integrating number of 20; MCT as the detector; and a temperature for the measurements of 35° C.

Figure 2:
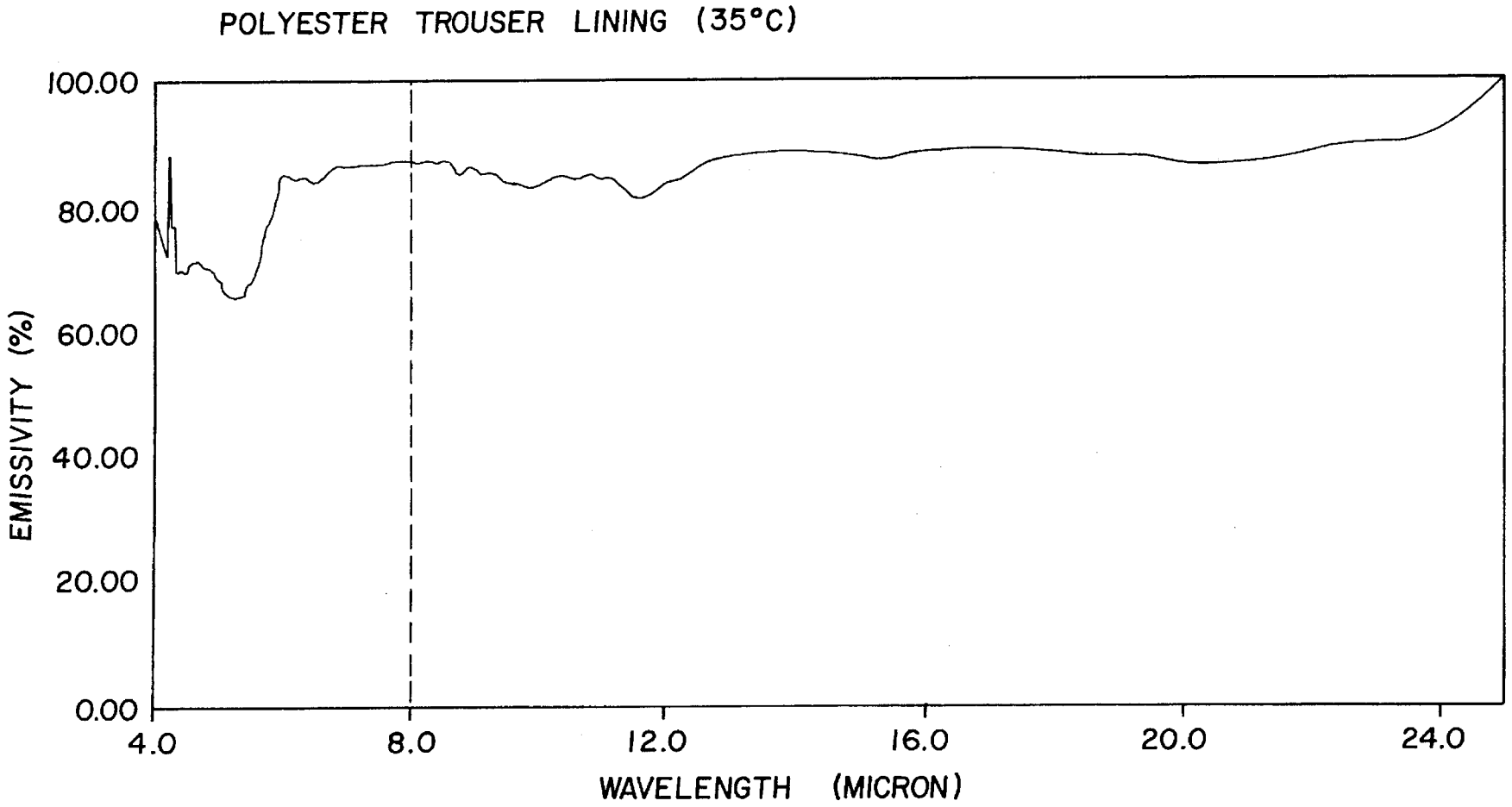
FIG. 2 is a graph showing the measured values of the emitting intensities of far infrared rays emitted from synthetic fiber impregnated with the liquid composition emitting far infrared rays in accordance with the present invention.

The results of the measurements indicated that the emissivity of the far infrared rays emitted from the synthetic fiber impregnated with the liquid composition according to the present invention ranged from about 65 to 80% at a wavelength range of 4.0 to 6.0 microns and more than 80% at a wavelength range of more than 8.0 microns, as shown in FIG. 1. Moreover, the results of the test measuring the emitting intensity indicated that an emitting intensity curve similar to that of a black body having the highest emitting intensity was obtained. That is, the results showed that the emitting intensity was similar to that of a black body.

EXAMPLE 4

Test for Antibacterial Effects 1000 ml of the liquid composition emitting far infrared rays produced in above Example 2 were mixed with 20 liters of purified water. Next, a woolen fabric with a dimension of 30 cm×30 cm was impregnated with the resultant mixture for 30 seconds and then dried to provide a test sample.

The test sample was sent to the Korea Textile Inspection and Testing Institute (KOTITI) so that it could be tested for antibacterial effects.

The testing was performed using a shake flask test at a temperature of 25° C. in the presence of *Staphylococcus aureus* (ATCC No. 6538).

As a result of the testing, it was confirmed that the number of microorganisms decreased by 73.8%.

EXAMPLE 5

Test for Deodorization 1000 ml of the liquid composition emitting far infrared rays prepared in above Example 2 were mixed with 20 liters of purified water. Next, a woolen fabric with a dimension of 30 cm×30 cm was impregnated with the resultant mixture for 30 seconds, and then dried to provide a test sample.

The test sample was sent to the Korea Textile Inspection and Testing Institute (KOTITI) so that it could be tested for deodorization.

With regard to the testing conditions, a sample having a dimension of 1 cm×1 cm and 1.0025 g of specific gravity was used, the amount of aqueous ammonia solution introduced was 5 μl, the amount of ammonia gas absorbed at 1 stroke was 100 ml, and the volume of the beaker used for the test was 2 liters. A gas detector method was used as the test method, and, from the measured number values, deodorization was calculated by the following equation:

$$\text{Deodorization (\%)} = \frac{\text{concentration of blank gas} - \text{concentration of test tube gas}}{\text{concentration of blank gas}} \times 100$$

Results of the measurements are shown in Table 1.

TABLE 1

| Time for Measurement | Blank Concentration (ppm) | Sample Concentration (ppm) | Deodorization (%) |
|---|---|---|---|
| Initial | 540.0 | 540.0 | — |
| After 30 minutes | 519.0 | 200.0 | 61.5 |
| After 60 minutes | 507.5 | 169.0 | 66.7 |
| After 90 minutes | 500.0 | 113.0 | 77.4 |
| After 120 minutes | 479.0 | 105.0 | 78.1 |

From the results shown in Table I, it can be confirmed that the deodorizing property of the fiber after being impregnated with the liquid composition emitting far infrared rays according to the present invention was excellent.

EXAMPLE 6

Test for Frictional Electricity Voltage

The polyester synthetic fiber test sample prepared according to above Example 3 was sent to the FITI Testing and Researching Institute to test and measure the frictional electricity voltage thereof.

The device and method used for the measurements was KS K 0555, B method, and the measurements were carried out under the following conditions: use of cotton as the friction testing cloth; a temperature of 20° C.; and a relative humidity of 65%.

Results of the measurement can be found in Table 2.

TABLE 2

| | Frictional Electricity Voltage (V) | Reduction of Electrification (%) |
|---|---|---|
| Untreated Cotton Cloth Sample | 520 | — |
| Treated Cotton Cloth Sample | 18 | 96.5 |

In addition, in order to measure the transmissions of the ultraviolet rays, a synthetic fiber was coated with the liquid composition emitting far infrared rays according to the present invention as described in above Example 3, and the coated fiber was sent to the FITI Testing and Researching Institute so that the transmissions of the ultraviolet rays could be measured. The device used for the measurement was a UV spectrophotometer.

The results of the measurement indicate that the average interception of a wavelength of 200 to 400 microns known to be harmful to humans is 98%, and that the average interception of a wavelength of 300 to 400 microns is 84%. Thus, it has been demonstrated that the interception of the ultraviolet rays by the synthetic fiber coated with the liquid composition of the present invention is more effective.

As described and confirmed above, when the liquid composition emitting far infrared rays according to the present invention is coated on products such as fiber products, it provides the coated product with excellent emissivity and emitting intensity similar to that of a black body. Furthermore, a fiber product with superior antibacterial effects, deodorization, and interception of ultraviolet rays and with reduced frictional electricity can be manufactured by using a liquid composition prepared in accordance with the present invention.

Although the preferred embodiments of the present invention have been disclosed for illustrative purposes, those skilled in the art will appreciate that various modifications, additions and substitutions are possible, without departing from the scope and spirit of the present invention as disclosed in the accompanying claims.

What is claimed is:

1. A method for the preparation of a liquid composition emitting far infrared rays, comprising the steps of:

dissolving sodium silicate, sodium aluminate, sodium oxide, sodium thiosulfate, germanium dioxide and highly pure white sugar in water at a temperature of 20° to 40 ° C. and mixing the dissolved solutions to resultingly prepare a first solution;

adding a second solution made by ionizing gold to chloroauric acid and a third solution made by ionizing silver nitrate to silver thiosulfate to the first solution; and maintaining the resultant mixture within a temperature range of 15° to 25° C. for 48 to 72 hours.

2. A method for the preparation of a liquid composition emitting far infrared rays as set forth in claim 1, wherein the highly pure white sugar of the first solution further includes glucose mixed therein.

3. A method for preparation of a liquid composition emitting far infrared rays as set forth in claim 1, wherein the first solution further includes an aqueous potassium carbonate solution added therein.

4. A method for preparation of a liquid composition emitting far infrared rays as set forth in claim 1, wherein, in the used amount of each component in the first solution, the weight ratio of the sodium thiosulfate to the sodium silicate ranges 1:5–20, the weight ratio of the sodium thiosulfate to the sodium aluminate ranges 1:2–8, the weight ratio of the sodium thiosulfate to the sodium oxide ranges 1:2–5, the weight ratio of the sodium thiosulfate to the highly pure white sugar ranges 1:5–12, the weight ratio of the sodium thiosulfate to the gold used in the second solution ranges 1:1–10, and the weight ratio of the sodium thiosulfate to the silver nitrate used in the third solution ranges 1:0.5–2.

5. A method for preparation of a liquid composition emitting far infrared rays as set forth in claim 3, wherein the weight ratio of the sodium thiosulfate to the potassium carbonate ranges 1:5–10.

6. A liquid composition emitting far infrared rays prepared in accordance with a method, comprising the steps of:

dissolving sodium silicate, sodium aluminate, sodium oxide, sodium thiosulfate, germanium dioxide and highly pure white sugar in water at a temperature of 20° to 40° C. and mixing the dissolved solutions to resultingly prepare a first solution;

adding a second solution made by ionizing gold to chloroauric acid and a third solution made by ionizing silver nitrate to silver thiosulfate to the first solution; and maintaining the resultant mixture within a temperature range of 15° to 25° C. for 48 to 72 hours.

7. A method for the preparation of a liquid composition emitting far infrared rays as set forth in claim 6, wherein the highly pure white sugar of the first solution further includes glucose mixed therein.

8. A liquid composition emitting far infrared rays as set forth in claim 6, wherein the first solution further includes an aqueous potassium carbonate solution added therein.

9. A fiber product which is coated or impregnated with a liquid composition as set forth in claim 6.

10. A method for preparation of a liquid composition emitting far infrared rays as set forth in claim 2, wherein, in the used amount of each component in the first solution, the weight ratio of the sodium thiosulfate to the sodium silicate ranges 1:5–20, the weight ratio of the sodium thiosulfate to the sodium aluminate ranges 1:2–8, the weight ratio of the sodium thiosulfate to the sodium oxide ranges 1:2–5, the weight ratio of the sodium thiosulfate to the highly pure white sugar ranges 1:5–12, the weight ratio of the sodium thiosulfate to the gold used in the second solution ranges 1:1–10, and the weight ratio of the sodium thiosulfate to the silver nitrate used in the third solution ranges 1:0.5–2.

11. A method for preparation of a liquid composition emitting far infrared rays as set forth in claim 3, wherein, in the used amount of each component in the first solution, the weight ratio of the sodium thiosulfate to the sodium silicate ranges 1:5–20, the weight ratio of the sodium thiosulfate to the sodium aluminate ranges 1:2–8, the weight ratio of the sodium thiosulfate to the sodium oxide ranges 1:2–5, the weight ratio of the sodium thiosulfate to the highly pure white sugar ranges 1:5–12, the weight ratio of the sodium thiosulfate to the gold used in the second solution ranges 1:1–10, and the weight ratio of the sodium thiosulfate to the silver nitrate used in the third solution ranges 1:0.5–2.

12. A fiber product which is coated or impregnated with a liquid composition as set forth in claim 7.

13. A fiber product which is coated or impregnated with a liquid composition as set forth in claim 8.

* * * * *